United States Patent [19]

Eagle

[11] 4,284,011

[45] Aug. 18, 1981

[54] RESTRAINT ASSEMBLY FOR THE HOPPER DOOR ACTUATOR OF A RAPID DISCHARGING RAILROAD HOPPER CAR

[75] Inventor: Joseph Eagle, Hebron, Ky.

[73] Assignee: Ortner Freight Car Company, Cincinnati, Ohio

[21] Appl. No.: 128,548

[22] Filed: Mar. 10, 1980

[51] Int. Cl.[3] ..... B61D 7/02; B61D 7/26; B61D 7/28

[52] U.S. Cl. ..... 105/310; 105/240; 105/250

[58] Field of Search ..... 105/285, 241.5, 253, 105/283, 287, 280, 290, 304, 310; 414/376

[56] References Cited

U.S. PATENT DOCUMENTS

| | | | |
|---|---|---|---|
| 3,187,684 | 6/1965 | Ortner | 105/248 |
| 3,596,609 | 8/1971 | Ortner et al. | 105/250 |
| 3,710,729 | 1/1973 | Schuller | 105/240 |
| 3,772,996 | 11/1973 | Schuller | 105/250 |
| 4,132,177 | 1/1979 | Funk | 105/310 |

*Primary Examiner*—Richard A. Bertsch
*Attorney, Agent, or Firm*—Frost & Jacobs

[57] ABSTRACT

A restraint assembly for the door-actuating means of a railroad hopper car. The door-actuating means is shifted by the piston of a fluid cylinder between door-closing and door-opening positions. The restraint mechanism comprises a first bracket mounted on the center sill and rotatively supporting a shaft on which a lever is mounted. The free end of the lever is pivotally joined to a first end of a spring assembly. The second end of the spring assembly is pivotally mounted to a second bracket affixed to the center sill. One end of the shaft has a notch formed therein. The door-actuating means has a laterally extending lug. When the door-actuating means is in its retracted door-closing position the restraint assembly will be in an over center restraining condition. Abutment of the door-actuating means lug against the shaft notch will prevent longitudinal shifting of the door-actuating means due to inertia. Shifting of the actuating means by the cylinder to its door-opening position will cause the abutment of the lug and the shaft notch to result in shifting of the restraint assembly to its non-restraining position and the door-actuating means lug no longer abuts the shaft notch. The door-actuating means is free to shift to its door-opening position. When the cylinder is actuated to shift the door-actuating means to its door-closing position, the door-actuating means lug engages the restraint shaft notch causing the assembly to return to its restraining position.

8 Claims, 7 Drawing Figures

RESTRAINT ASSEMBLY FOR THE HOPPER DOOR ACTUATOR OF A RAPID DISCHARGING RAILROAD HOPPER CAR

TECHNICAL FIELD

The invention relates to a restraint assembly for a hopper car door actuator, and more particularly to such a restraint assembly which will prevent shifting of the door actuator to its door-opening position due to impact inertia.

BACKGROUND ART

Heretofore, the discharge doors of a hopper car having generally been opened and closed manually, each door being provided with its own manually actuated latch means by which it may be locked in its closed position. In recent years, hopper cars have been developed which are of greatly increased size and capacity, with larger and heavier hopper doors. Prior art workers have devised for such cars various types of automatic door actuating means by which the large hopper doors may be mechanically opened and closed. At the same time, various types of latch means have been developed to lock the door actuating means in its door-closing position, thereby maintaining the hopper doors in their closed positions.

Prior art door actuator latch means have frequently been characterized by complex structure and have been difficult and expensive to manufacture and assemble. Furthermore, many of the prior art latch means were of such nature that under certain dynamic conditions of the hopper car (including humping, train shocks, train action and slack run-in and run-out), the latch means could unintentionally assume an unlatched condition due to impact inertia, with the possible risk of unwanted discharge of the car load.

Exemplary latch means for automatic door actuating means are taught in U.S. Pat. Nos. 3,710,729 and 3,772,996. U.S. Pat. No. 4,132,177 teaches latch means for automatic door actuating means, which latch means also includes restraint means to prevent the latch from unintentionally assuming an unlatched condition due to impact inertia.

Under some circumstances a complex latch mechanism is not necessary and it is desirable simply to provide the hopper car with restraint means to prevent shifting of the automatic door actuating means to its door-open position due to impact inertia. The present invention is directed to a restraint assembly for a hopper car door actuator of the type comprising a door-actuating beam shiftable longitudinally by a fluid cylinder between door-opening and door-closing positions. Such automatic door actuating means are taught, for example, in U.S. Pat. Nos. 3,187,684 and 3,596,609. The restraint assembly of the present invention is simple in construction and easy to install on the hopper car. The restraint assembly prevents inadvertent hopper door opening when impact inertia tends to extend the piston rod of the fluid cylinder which, in the absence of the restraint assembly of the present invention, could result in the shifting of the door-actuating beam to its door-open position.

DISCLOSURE OF THE INVENTION

According to the invention there is provided a restraint assembly for the door-actuating means of a railroad hopper car of the type having a plurality of hopper doors arranged in opposed pairs and swingable between a closed position and a downwardly depending open position. The door actuating means comprises a door-actuating beam operatively connected to the doors and shiftable by the piston of a fluid cylinder between a retracted door-closing position and an extended door-opening position. The door-actuating beam may, if desired, be mounted beneath the center sill of the hopper car and provided with an upwardly directed extension which passes through a longitudinal slot in the upper surface of the center sill.

The piston of the fluid cylinder is provided with a piston rod which terminates in a clevis. The piston rod clevis is pivotally attached to the door-actuating beam extension above the center sill. Thus, when the fluid cylinder is actuated such that its piston rod will shift to its extended position, the piston rod will cause shifting of the door-actuating beam from its retracted door-closing position to its extended door-opening position. This in turn will cause the doors to achieve their downwardly depending open positions, due to their operative connection to the door-actuating beam.

When the fluid cylinder is so actuated that its piston rod shifts to its retracted position, the piston rod will at the same time shift the door-actuating beam to its retracted position returning the hopper doors to their closed position.

The restraint mechanism of the present invention comprises a first bracket mounted on the upper surface of the center sill and rotatively supporting a shaft on which a lever is mounted. The free end of the lever is pivotally joined to the first end of a spring assembly. The second end of the spring assembly is pivotally mounted to a second bracket affixed to the upper surface of the center sill. The first and second bracket are so positioned on the upper surface of the center sill that the distance between the shaft and the pivotal mounting of the second end of the spring assembly is less than the combined length of the lever and the spring assembly.

One end of the restraint assembly shaft has a notch formed therein. The door-actuating beam extension has a laterally extending lug adapted to cooperate with the shaft notch. When the door-actuating beam is in its retracted door-closing position, the restraint assembly will be in restraining condition with the pivotal attachment of the first spring assembly end and the free end of the lever lying above an imaginary line drawn between the center of the restraint assembly shaft and the center of the pivotal mounting of the second end of the spring assembly. When the lever is in this position, the rotative position of the shaft to which it is mounted is such that one side of the notch therein serves as an abutment for the door-actuating beam extension lug. Abutment of the door actuating beam extension lug against this one side of the shaft notch will prevent longitudinal shifting of the door-actuating beam to its hopper door-open position due to impact inertia. However, when the door-actuating beam is shifted by the fluid cylinder to its door-opening position, the door-actuating beam extension lug, abutting the first side of the shaft notch, will cause rotation of the shaft notch and its lever, against the action of the spring assembly, until the pivotal connection between the first end of the spring assembly and the free end of the lever passes to an over-center position below the above mentioned imaginary line and the first side of the shaft notch no longer is in position to be abutted by the door-actuating beam extension lug, so that the door-actuating beam is free to shift to its door-opening position.

When the fluid cylinder is actuated in the opposite direction to shift the door-actuating beam to its door-closing position, the door-actuating beam extension lug engages a second side of the shaft notch and causes the shaft to rotate to its first described position resulting in return of the lever and spring assembly to their over-center restraining positions.

BRIEF DESCRIPTION OF THE DRAWINGS

FIG. 5 is a fragmentary cross sectional view taken along section line 5—5 of FIG. 3 and illustrates the restraint assembly in its restraining condition.

BEST MODE OF CARRYING OUT THE INVENTION

Figure 1:
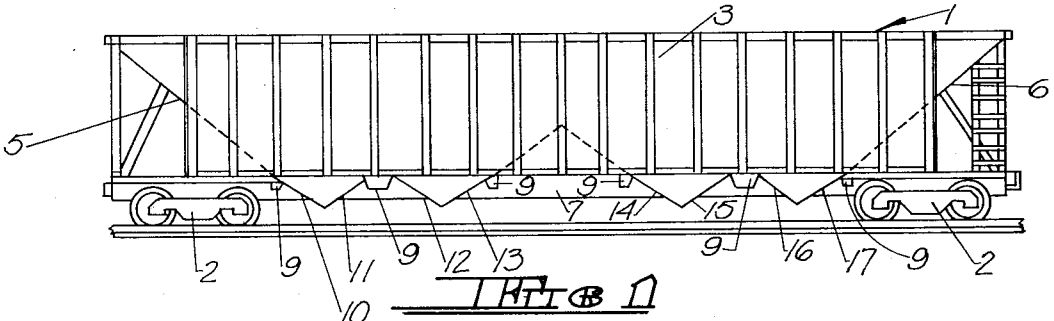
FIG. 1 is a semi-diagrammatic elevational view of an exemplary hopper car to which the restrain assembly of the present invention may be applied.

As indicated above, the latch means of the present invention is for use on that kind of hopper car the doors of which are opened and closed through the agency of a door-actuating beam shiftable longitudinally by a fluid cylinder. While not intended to be so limited, for purposes of an exemplary showing the latch means will be described in its application to a modern hopper car of the type taught in U.S. Pat. No. 3,596,609. Such a hopper car is illustrated in FIG. 1 and comprises an elongated body generally indicated at 1, mounted on conventional trucks 2. The car body comprises vertical side walls, one of which is shown at 3 together with inclined end walls or slope sheets 5 and 6.

The body 1 is mounted on an under frame comprising a longitudinally extending center sill 7, longitudinally extending side sills (one of which is shown at 8) and transverse brace members 9 extending from the center sill to the side sills. It will be understood that both the underframe and the car body will be provided with additional bracing members and the like, the nature of which does not constitute a limitation on the present invention. Openings in the bottom of the exemplary hopper car of FIG. 1 are closed by opposed pairs of cooperating hopper doors 10-11, 12-13, 14-15 and 16-17.

Figure 2:
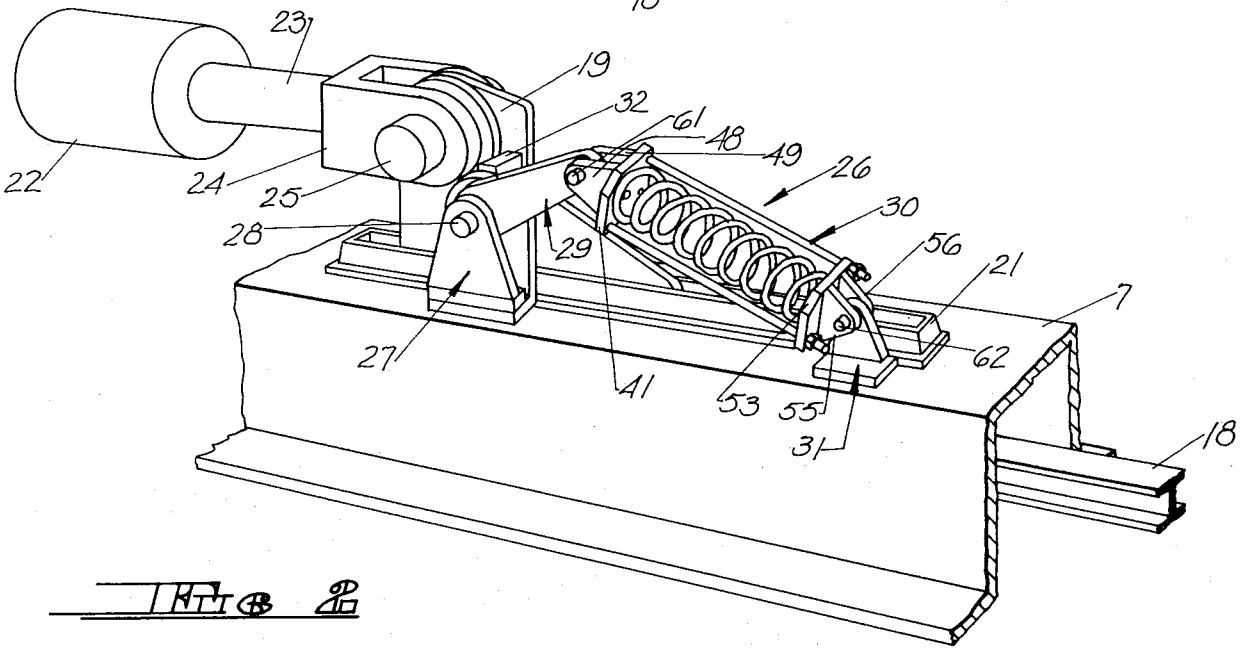
FIG. 2 is a fragmentary perspective view of the center sill, door-actuating beam and cylinder of the hopper car of FIG. 1, with the restrain assembly of the present invention applied thereto.

FIG. 2 fragmentarily illustrates the center sill 7 of the hopper car of FIG. 1. A door actuating beam 18 is mounted beneath the center sill 7 by appropriate means (not shown) permitting the beam 18 to shift longitudinally. An upwardly directed extension 19 is affixed to the beam 18 and passes through a slot 20 (see FIG. 3) in the upper surface of center sill 7. A slotted casting 21 is welded to the center sill 7 at the position of slot 20 so as to strengthen the center sill at that position. A fluid actuated cylinder 22 is mounted on center sill 7 or otherwise appropriately affixed to a frame member of the hopper car. For purposes of this discussion, the fluid cylinder 22 may be considered to be an air cylinder. The cylinder 22 has a piston rod 23 terminating at its forward end in a clevis 24 pivotally attached to extension 19 by pivot pin 25.

In FIG. 2, the door-actuating beam 18 is shown in its retracted door-closing position. When piston rod 23 of cylinder 22 is extended, the door-actuating beam 18 will shift to the right (as viewed in FIG. 2) to its extended door-opening position.

It will be understood that the transversely extending hopper doors 10 through 17 are each swingable between a closed position (shown in FIG. 1) and a downwardly depending open position. The means by which the longitudinal shifting of door-actuating beam 18 opens and closes doors 10 through 17 do not constitute a limitation of the present invention. Exemplary means to accomplish this purpose are taught in the above mentioned U.S. Pat. No. 3,596,609. Briefly, these means comprise a series of shafts extending transversely of the hopper car beneath the hopper doors. Each shaft carries a door lever non-rotatively mounted thereon. Each lever has one or two arms connected to one or both adjacent hopper doors by adjustable link means. Rotation of the shafts will cause the door levers and links thereon to shift the hopper doors to which they are connected between their open and closed positions, passing through a dead center position. Each of the transverse shafts carries a centrally located lever. The door-actuating beam is provided with a push rod for each centrally located shaft lever which is operatively connected thereto. Through the agency of this combination of shafts, levers, links and push rods, a shifting of the door-actuating beam 18 between its retracted door-closing position and extended door-opening position will shift the hopper doors between their closed and open positions.

FIG. 2 illustrates the major elements of the restraint assembly of the present invention. The restraint assembly is generally indicated at 26 and comprises a first bracket generally indicated at 27, a shaft rotatively supported by first bracket 27 and generally indicated at 28, a lever generally indicated at 29 mounted on shaft 28 and a spring assembly generally indicated at 30. A first end of the spring assembly is pivotally affixed to the free end of shaft 29 and the second end of the spring assembly 30 is pivotally affixed to a second bracket, generally indicated at 31. To complete the assembly, the upwardly directed extension 19 is provided with a laterally disposed lug 32.

Figure 3:
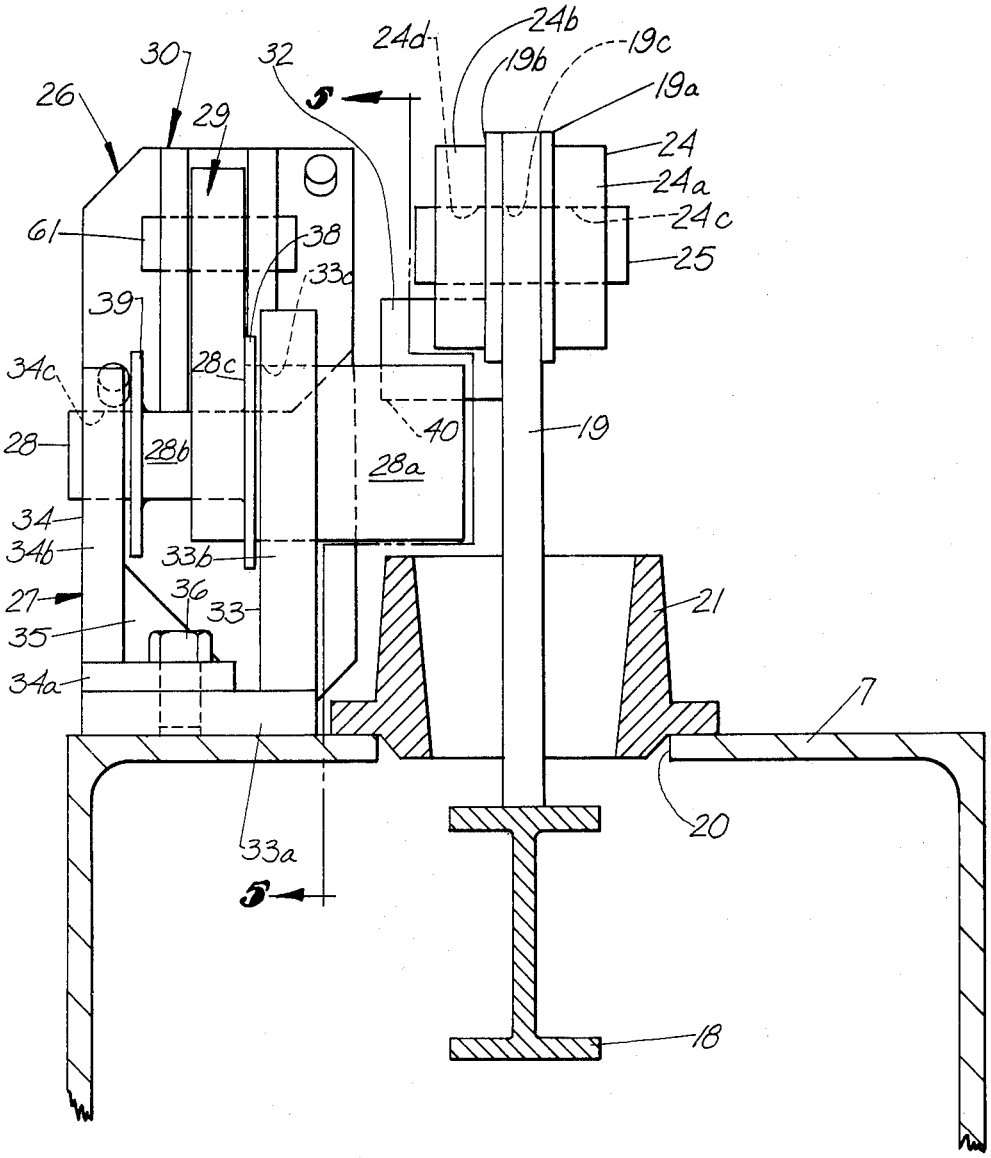
FIG. 3 is a fragmentary end elevational view, partly in cross section, of the restraint assembly of the present invention, as viewed from the left in FIG. 2.

For a more detailed description of the individual elements of the restraint assembly 26, reference is now made to FIGS. 3 and 5, wherein like parts have been given like index numerals. In FIGS. 3 and 5 the center sill 7 is fragmentarily shown. In FIG. 3 the longitudinal slot 20 in the center sill 7 and the reinforcing casting 21 are also shown. In both Figures the door-actuating beam 18 is illustrated together with its upwardly directed extension 19. It will be noted that extension 19, near its upper end, is provided with a pair of reinforcing, annular bosses **19*a* and 19*b* with a perforation 19*c* passing therethrough. The piston clevis 24 has a pair of bifurcations 24*a* and 24*b* lying to either side of the reinforcing bosses 19*a* and 19*b* and provided with perforations 24*c* and 24*d*, respectively, which are coaxial with the perforation 19*c*. The pivot pin 25 passes through perforations 24c, 19c and 24d so as to pivotally affix the clevis 24 to extension 19. Pivot pin 25 may be maintained in position and precluded from axial shifting in the perforations by any suitable means (not shown) such as cotter pins or the like passing through transverse perforations in the free ends of the pivot pin. The laterally extending lug 32 of extension 19** is affixed to the extension by any appropriate means including welding or the like.

The first bracket 27 is made up of two bracket parts 33 and 34 to enable assembly of the bracket and the shaft 28 it supports. The first bracket part 33 comprises a base portion 33a and an upstanding portion 33b. The base portion is welded or otherwise appropriately affixed to the upper surface of center sill 7. The upstanding portion 33b has a perforation 33c therethrough to rotatively receive shaft 28. The second bracket portion 34 of bracket 27 comprises a base portion 34a and an upstanding portion 34b. Bracket portion 34 may be additionally reinforced by a triangular member 35. Bracket base portion 34a is affixed to bracket base portion 33a by a pair of bolts 36 and 37. The upstanding part 34b of bracket portion 34 is provided with a perforation 34c adapted to rotatively receive shaft 28. Bracket portions 33 and 34, when assembled, form the U-shaped first bracket 27. It will be understood that bracket parts 33 and 34 can each be fabricated of individual elements welded or otherwise affixed together, or they could each constitute an integral, one-piece casting.

The shaft 28 has a first portion 28a of large diameter and a second portion 28b of smaller diameter, forming a shoulder 28c therebetween. The perforation 33c in bracket part 33b is of such diameter as to rotatively receive the large diameter portion 28a of shaft 28. Similarly, the perforation 34c of bracket part 34b is of such diameter as to rotatively receive the small diameter portion 28b of shaft 28.

The lever 29 is non-rotatively mounted on the small diameter portion 28b of shaft 28 adjacent shoulder 28c. The lever may be keyed, pinned or welded in place on shaft portion 28b. The large diameter portion 28a of shaft 28 is provided with a washer 38 rotatively mounted thereon between the lever 29 and the adjacent upstanding portion 33b of bracket part 33. The washer serves as a spacer and a bearing surface between bracket portion 33b and lever 29. It will be understood that axial shifting of shaft 28 to the right as viewed in FIG. 3 is limited by washer 38 and lever 29 cooperating with bracket portion 33b.

The small diameter portion 28b of shaft 28 is provided with a washer 39 nonrotatively affixed thereto as by welding or the like. Washer 39 serves both as a bearing and a spacer, cooperating with upstanding bracket portion 34b to prevent axial shifting of shaft 28 to the left as viewed in FIG. 3.

As is most clearly seen in FIG. 3, the large diameter portion 28a of shaft 28 extends beyond the upstanding bracket portion 33b toward extension 19 of door-actuating beam 18. This free end of the large diameter shaft portion 28a has a notch 40 formed therein. The notch 40 is most clearly shown in FIG. 5 and has a first side 40a and a second side 40b. The purpose of notch 40 and its sides 40a and 40b will be described hereinafter.

Figure 4:
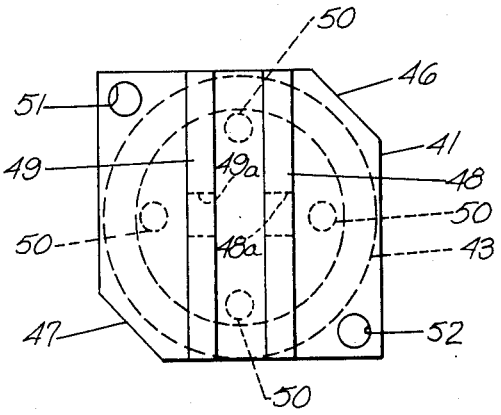
FIG. 4 is a front elevational view of the front end of the spring assembly of the present invention.

For a description of spring assembly 30, reference is now made to FIGS. 4 and 5. The spring assembly 30 comprises a front plate 41, a rear plate 42 a helical compression spring 43 and a pair of rods 44 and 45. The front plate 41, at the front end of spring assembly 30, is illustrated in FIG. 4. The front plate 41 is substantially square in configuration with diagonally opposite corners relieved for clearance, as at 46 and 47. The front plate 41 has a pair of substantially triangular lugs 48 and 49 affixed thereto in parallel spaced relationship. The lugs 48 and 49 are provided with coaxial perforations 48a and 49a, the purpose of which will be described hereinafter. The opposite face of front plate 41 is provided with a plurality of protrusions 50, the purpose of which is to maintain compression spring 43 centered with respect to the plate. Finally, the plate is provided with a pair of holes 51 and 52 through which the front ends of rods 44 and 45, respectively, extend. The front ends of rods 44 and 45 are welded or otherwise permanently affixed in the holes 51 and 52.

The rear plate 42 of spring assembly 30 is a mirror image of front plate 41, being otherwise identical. Thus, the rear plate 42 is substantially square in configuration having diagonally opposite ends relieved for clearance purposes, as at 53 and 54 (see also FIG. 2). The rear surface of rear plate 42 is provided with a pair of substantially triangular lugs 55 and 56 equivalent to lugs 48 and 49 of front plate 41. The lugs 55 and 56 have coaxial perforations extending therethrough similar to perforations 48a and 49a. One such perforation is shown at 56a in FIG. 5. The front face of rear plate 42 will be provided with a plurality of protrusions (not shown) similar to the protrusions 50 of front plate 41, again serving to maintain the adjacent end of compression spring 43 centered with respect to rear plate 42. Finally, rear plate 42 has a pair of holes 57 and 58 through which the rearward ends of rods 44 and 45 pass with clearance. The rearward ends of rods 44 and 45 are threaded to accept nuts 59 and 60, respectively. In this way, the rods 44 and 45 serve to maintain the spring assembly 30 in assembled condition. When the spring assembly is compressed so that front plate 41 shifts toward rear plate 42, rods 44 and 45 are free to shift through the holes 57 and 58 of rear plate 42 to accommodate for this shortening of the spring assembly.

As is clearly shown in FIGS. 2, 3 and 5, the front plate 41 of spring assembly 30 is pivotally affixed to the free end of lever 29. To this end, the free end of lever 29 is provided with a perforation which can be aligned with perforations 48a and 49a in front plate lugs 48 and 49 for the receipt of a pivot pin 61. The pivot pin 61 may be held in place and precluded from axial shifting by any appropriate means (not shown) such as cotter pins passing through transverse perforations in the free ends of the pivot pin 61. Alternatively, one end of the pivot pin may be provided with a head and the other end of the pivot pin may be secured by a cotter pin.

The rearward end of spring assembly 30 is pivotally affixed to second bracket 31. Second bracket 31 comprises a base portion 31a welded or otherwise affixed to the upper surface of center sill 7 and an upstanding portion 31b. The upstanding portion has a perforation formed therein which may be aligned with the perforations in the lugs 55 and 56 of rear plate 42 for receipt of a pivot pin 62. The pivot pin 62 may be of the type described with respect to pivot pin 61.

The restraint assembly of the present invention having been described, its operation may be set forth as follows. In FIGS. 2, 3 and 5 the restraint assembly is illustrated in its restraining condition. Reference is made in particular to FIG. 5. When the piston rod 23 and clevis 24 of fluid cylinder 22 are in their fully retracted positions so that the door actuating beam 18 and its extension 19 are also in their fully retracted door-closing positions, these elements will normally be in a position further to the right than illustrated in FIG. 5. If, under the influence of inertia, these elements tend to shift to the left as viewed in FIG. 5 (i.e. toward the door-opening position), the lug 32 of the door-actuating beam extension 19 will contact and abut the first surface 40*a* of notch 40 and will therefore be stopped from further travel to the left (as viewed in FIG. 5). This will preclude unwanted opening of the hopper car doors due to inertia forces. It will be noted from FIG. 5 that the first bracket 27 and the second bracket 31 are so located on center sill 7 that the distance between shaft 28 and pivot pin 62 (which joins the rear end of spring assembly 30 to bracket 31), is less than the effective length of lever 29 and spring assembly 30. Pivot pin 61 joining lever 29 to the front end of spring assembly 30 lies above an imaginary line 63 drawn through the axes of shaft 28 and pivot pin 62. Thus, the lever 29 and spring assembly 30 are, when in their restraining condition, in an over-center position. The spring 43 of spring assembly 30 is so chosen that it will resist the force of door-actuating beam extension lug 32 against the first surface 40*a* of notch 40 due to inertia.

Figure 6:
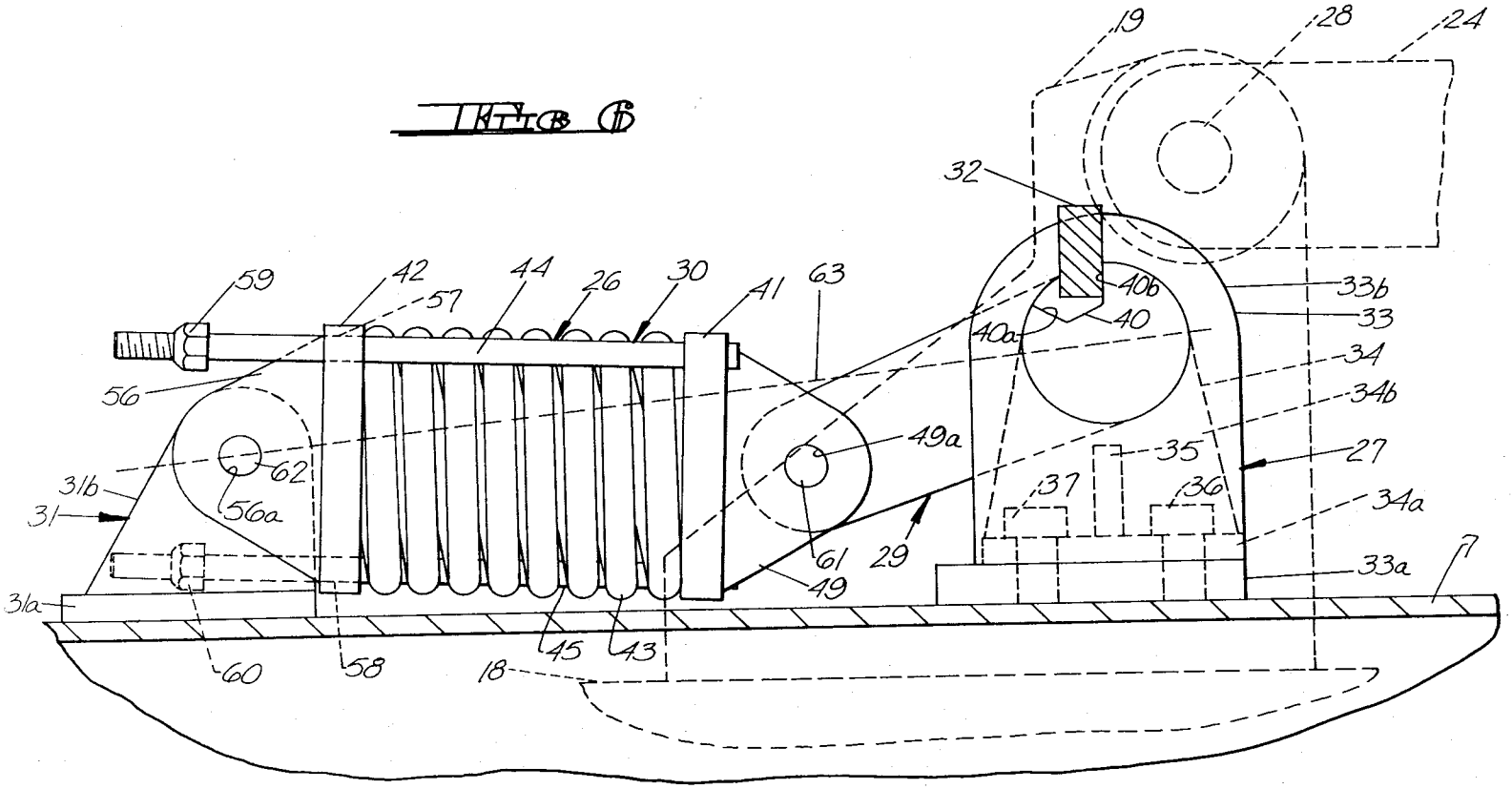
FIG. 6 is a fragmentary cross sectional view, similar to FIG. 5, but illustrating the restraint assembly in its non-restraining condition.

When it is desired to purposely open the hopper doors, the fluid actuated cylinder 22 is activated. This will result in movement of piston rod 23, clevis 24, beam extension 19 and door actuating beam 18 to the left in FIG. 5 until the lug 32 abuts the first surface 40*a* of notch 40, as shown in FIG. 5. The activated cylinder imparts sufficient force to overcome spring assembly 30 and these elements will continue their movement to the left resulting in rotation of shaft 28 in a counterclockwise direction (as viewed in FIG. 5) by lug 32. Since lever 29 is non-rotatively mounted on shaft 28, it too will rotate in a counterclockwise direction resulting in compression of spring assembly 30. This rotation will continue until pivot pin 61 passes through imaginary line 63, whereupon the lever 29 and spring assembly 30 will snap to the position illustrated in FIG. 6 (i.e. their non-restraining position). FIG. 6, wherein like parts have been given like index numerals, illustrates the restraint assembly at the moment it snaps to its non-restraining condition. It will be evident from the Figure that the first surface 40*a* of notch 40 has now rotated out of the way of lug 32 with the result that piston rod 23, clevis 24, extension 19 and door-actuating beam 18 are now free to shift further to the left (as viewed in FIG. 6) to shift the hopper doors from their closed to their downwardly depending open positions.

When it is desired to close the hopper doors, the fluid cylinder 22 is activated in the opposite direction. This will result in a shifting of piston rod 23, clevis 24, beam extension 19 and door-actuating beam 18 to the right as viewed in FIG. 6. As these elements shift to the right, the lug 32 will engage the second surface 40*b* of notch 40. FIG. 6 illustrates the relative positions of the parts at the moment of this engagement. Further movement of these elements to the right will cause rotation of shaft 28 and lever 29 in a clockwise direction as viewed in FIG. 6). Once pivot pin 61 passes through the imaginary line 63, the restraint assembly 26 will snap to its restraining condition as illustrated in FIG. 5. This rotates the second surface 40*b* of notch 40 out of the way of lug 32 so that lug 32 and thus piston rod 23, clevis 24, extension 19 and door-actuating beam 18 can continue to shift to the right to their retracted, door-closing positions.

In a hopper car of the type described in the above mentioned U.S. Pat. No. 4,132,177, the connecting elements between actuating beam 18 and the hopper doors 10 through 17 may be adjusted, if desired, that the door-actuating beam 18 will open selected pairs of doors in sequence, but will close all of the doors simultaneously. The operation of the restraint assembly 26, as described above, is such that the restraint assembly is shifted from its restraining to it non-restraining condition prior to the actual opening of the hopper doors. Thus, the fluid cylinder 22 is not required to shift the restraint assembly 26 from its restraining to its non-restraining condition and open the hopper doors simultaneously. Alternatively, the restraint assembly may be so dimensioned and configured as to make its shift from restraining condition to non-restraining condition substantially simultaneously with the opening of the doors. During the door-closing operation, however, in an instance wherein the door-actuating beam is set up to close all of the hopper doors simultaneously, the cylinder is required only to shift pivot pin 61 of restraint assembly 26 through imaginary line 63, (through contact of lug 32 by first notch surface 48) whereupon the restraint assembly will snap to its non-restraining condition assisting the actuating beam 18 in bringing the doors to their final over-center closed positions.

Figure 7:
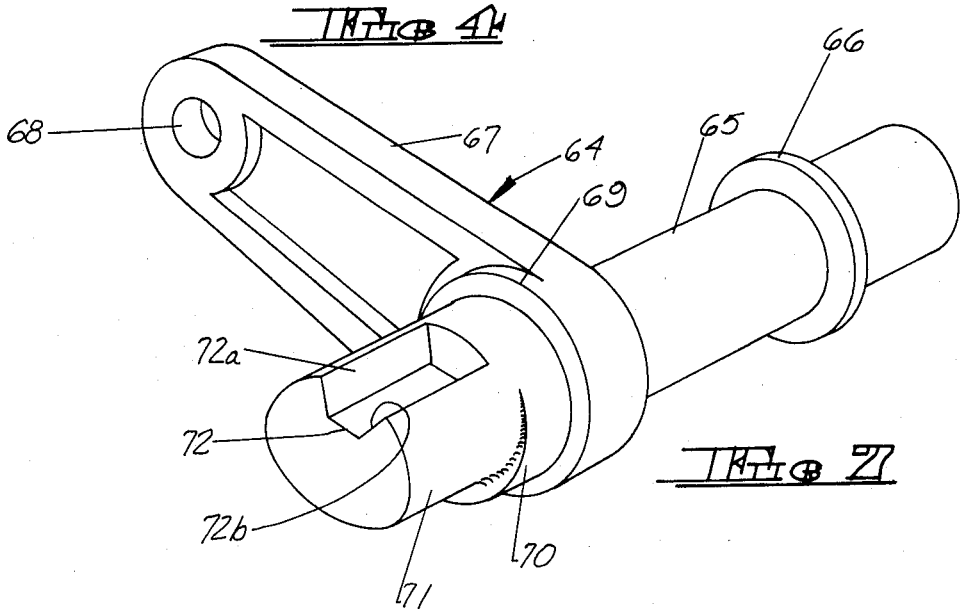
FIG. 7 is a perspective view of the shaft and lever of the restraint assembly of the present invention in the form of an integral, one-piece casting.
Figure 3:
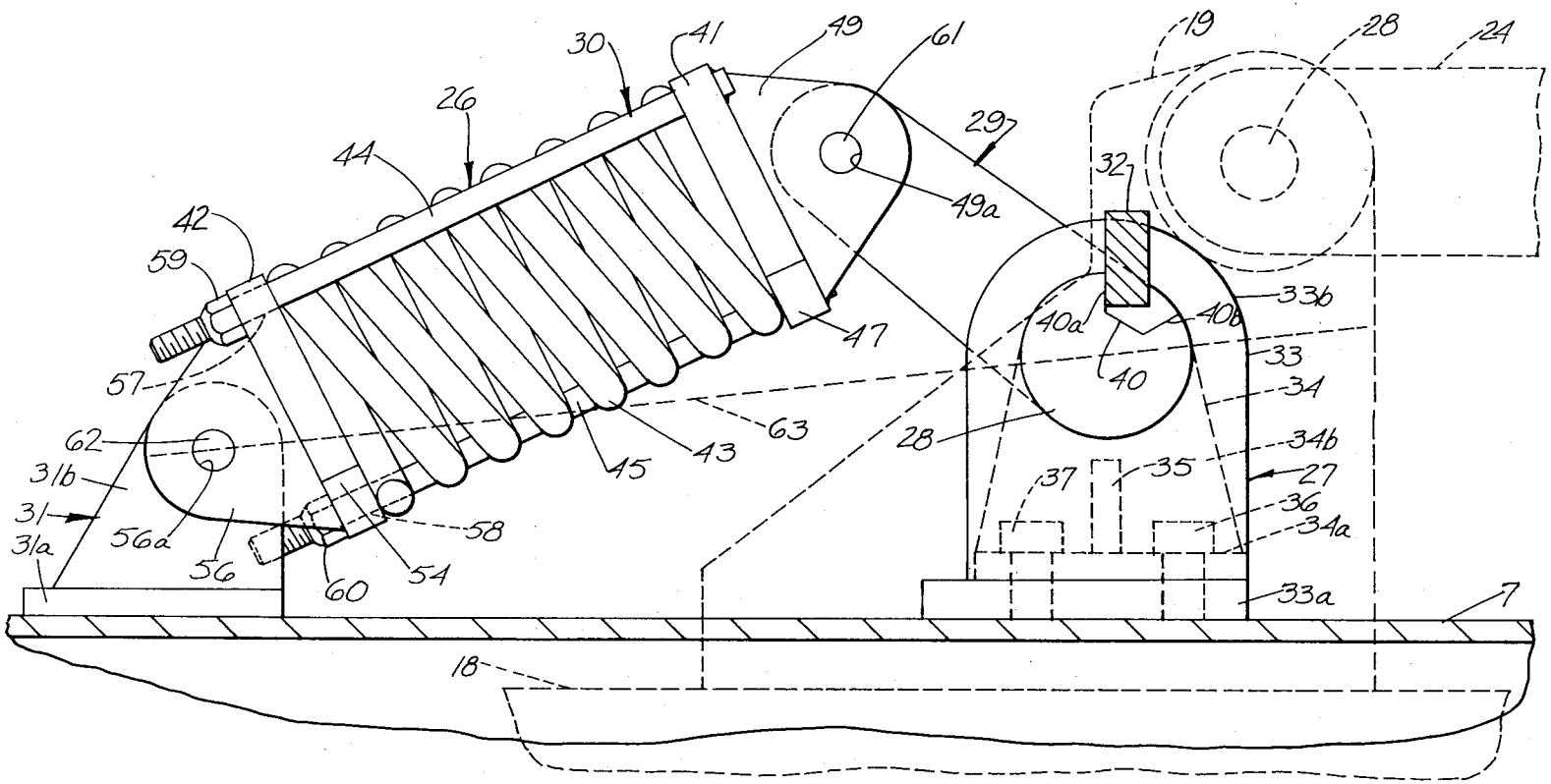

Reference is now made to FIG. 7. FIG. 7 illustrates that shaft 28, lever 29 and washers 38 and 39 can be made in the form of a single, integral, one-piece casting. The structure of FIG. 7 is generally indicated at 64 and has a first small diameter portion 65 equivalent to small diameter portion 28*b* of shaft 28. Integrally formed on the portion 65 is an upstanding annular flange 66 equivalent to and serving the same purpose as welded washer 39 of shaft 38. An elongated lever portion 67 is substantially identical to lever 29. At its forward end the lever portion 67 is provided with a perforation 68 equivalent to perforation 49*a* of lever 29 and adapted to receive the pivot pin 61 so that the lever portion 67 may be attached to spring assembly 30.

The structure 64 has an annular portion 69 adjacent lever portion 67 serving as a spacer and being surface similar to washer 38 of shaft 28. Immediately adjacent thereto, the structure 64 has another annular portion 70 of such diameter as to be rotatively received in perforation 33*c* of the upstanding portion 33*b* of bracket 27. Finally, adjacent portion 70, there is a portion 71 of substantially oval configuration for purposes of material savings. The oval portion 71 contains a notch 72 having a first surface 72*a* and a second surface 72*b*. The notch 72 is equivalent to notch 40 and its surfaces 72*a* and 72 are equivalent to notch surfaces 40*a* and 40*b* on shaft 28. It will be understood that the small diameter portion 65 is so dimensioned as to be rotatively received in the perforation 34*c* of the upstanding portion 34*b* of bracket 27. The casting 64 will function in precisely the same manner as described with respect to shaft 28, lever 29 and washers 38 and 39.

Modifications may be made in the invention without departing from the spirit of it. For example, there are door actuating systems wherein the clevis of the cylinder rod is connected through a pivoting lever to door actuating means which may take various forms such as a longitudinal beam, a segmented beam or the like. One such system is shown, for example in U.S. Pat. No. 3,772,996. With modification well within the skill of the worker in the art, the restraint assembly of the present invention may be adapted to such door actuating systems.

What is claimed is:

1. In a railroad hopper car of the type having a plurality of hopper doors arranged in opposed pairs and swingable between a closed position and a downwardly depending open position, and door-actuating assembly comprising a fluid operated cylinder and a door-actuating means operatively connected to said hopper doors, said cylinder having a piston rod connected to said door-actuating means, said piston rod and said door-actuating means being shiftable by said cylinder between a retracted door-closing position and an extended door-opening position, the improvement comprising a restraint assembly for said door-actuating assembly to prevent unintentional shifting of said piston rod and said door-actuating means from said retracted door-closing position to said extended door-opening position due to inertia, said restraint assembly comprising a first bracket mounted on said car, a shaft rotatively mounted in said bracket, a lever non-rotatively mounted on said shaft, a spring assembly having first and second ends, said lever having a free end pivotally joined to said first end of said spring assembly, a second bracket affixed to said car, said second end of said spring assembly being pivotally mounted to said second bracket, the distance between said shaft and said pivotal mounting of said second end of said spring assembly being less than the combined length of said lever and said spring assembly in extended condition, one end of said shaft extending beyond said first bracket and having a notch formed therein, said notch having first and second sides constituting first and second abutment surfaces, a lug mounted on said door actuating means, said pivotal attachment of said free end of said lever and said first end of said spring assembly lying in a first over-center position above an imaginary line drawn between the axial center of said shaft and the center of said pivotal mounting of said second end of said spring assembly when said restraint assembly is in its restraining condition and said piston rod and door-actuating means are in their retracted door-closing position, said lug on said door-actuating means being so positioned as to contact said first abutment surface of said notch to prevent longitudinal shifting of said door-actuating means to open said hopper doors due to inertia, said shaft being rotatable by said abutment of said lug and said first abutment surface when said piston rod is shifted by said cylinder toward said door-opening position to rotate said lever against the action of said spring assembly until said pivotal connection between said free end of said lever and said first end of said spring assembly passes to a second over-center position below said imaginary line and said restraint assembly achieves a non-restraining condition wherein said first abutment surface of said shaft notch is no longer in position to be abutted by said door-actuating means lug and said door-actuating means is free to shift to its door-opening position, said door-actuating means lug being so positioned as to engage said second abutment surface of said shaft notch to rotate said shaft and return said restraint assembly to its restraining condition with said pivotal connection between said lever free end and said spring assembly first end being in said first over-center position when said cylinder is actuated to shift said piston rod and said door-actuating means to said door-closing position.

2. The structure claimed in claim 1 wherein said first bracket comprises first and second L-shaped members, said first L-shaped member having a horizontal base portion affixed to said car and a vertical portion having a perforation therein to rotatively mount one end of said shaft, said second L-shaped member having a horizontal base portion removably affixed to said base portion of said first L-shaped member and a vertical portion having a perforation therein to rotatively mount the other end of said shaft, means on said shaft to prevent axial shifting of said shaft with respect to said vertical portions of said first and second L-shaped members.

3. The structure claimed in claim 2 wherein said shaft, said lever and said means to prevent axial shifting of said shaft with respect to said first bracket all constitute a single, one piece casting.

4. The structure claimed in claim 2 wherein said shaft, said lever and said means to prevent axial shifting of said shaft with respect to said first bracket all constitute a single, one piece casting.

5. The structure claimed in claim 1 wherein said spring assembly comprises a front plate, a rear plate and a coil spring, said coil spring having a first end abutting said front plate and a second end abutting said rear plate, means on said front and rear plates to maintain their respective first and second abutting coil spring ends centered with respect thereto, said front plate having a pair of parallel, rearwardly extending rod-like members mounted thereon, said rear plate having a pair of perforations, said rod-like members passing through said rear plate perforations with a sliding fit, said rod-like members being located at diametrically opposed positions along side said coil spring to maintain proper alignment of said coil spring and said front and rear plates, a pair of forwardly projecting lugs on said front plate lying to either side of said free end of said lever, said lugs and said free end of said lever having transverse perforations therein with a pivot pin extending therethrough, said second bracket comprising a base portion affixed to said upper surface of said center sill and an upstanding vertical portion, a pair of rearwardly extending lugs on said rear plate lying to either side of said vertical portion of said second bracket, said last mentioned lugs and said vertical portion of said second bracket having transverse perforations with a pivot pin extending therethrough.

6. In a railroad hopper car of the type having a longitudinal center sill of substantially inverted U-shape, a plurality of hopper doors arranged in opposed pairs and swingable between a closed position and a downwardly depending open position, and door-means comprising a fluid operated cylinder mounted above said center sill and a door-actuating beam mounted beneath said center sill, operatively connected to said hopper doors, and having an upwardly directed extension passing through a longitudinal slot in the upper surface of said center sill, said cylinder having a piston rod connected to said door-actuating beam extension above said center sill, said piston rod and said door-actuating beam being longitudinally shiftable by said cylinder between a retracted door-closing position and an extended door-opening position, the improvement comprising a restraint assembly for said door actuating means to prevent unintentional shifting of said piston rod and said door-actuating beam from said retracted door-closing position to said extended door-opening position due to inertia, said restraint assembly comprising a first bracket mounted on the upper surface of said center sill, a shaft rotatively mounted in said bracket and extending transversely of said center sill, a lever non-rotatively mounted on said shaft, a spring assembly having first and second ends, said lever having a free end pivotally joined to said first end of said spring assembly, a second bracket affixed to the upper surface of said center sill, said second end of said spring assembly being pivotally mounted to said second bracket, the distance between said shaft and said pivotal mounting of said second end of said spring assembly being less than the combined length of said lever and said spring assembly in extended condition, one end of said shaft extending beyond said first bracket and having a notch formed therein, said notch having first and second sides constituting first and second abutment surfaces, said door actuating beam extension having a laterally extending lug mounted thereon said pivotal attachment of said free end of said lever and said first end of said spring assembly lying in a first over-center position above an imaginary line drawn between the axial center of said shaft and the center of said pivotal mounting of said second end of said spring assembly when said restraint assembly is in its restraining condition and said piston rod and door-actuating beam are in their retracted door-closing position, said lug on said door-actuating beam extension being so positioned as to contact said first abutment surface of said notch to prevent longitudinal shifting of said door-actuating beam to open said hopper doors due to inertia, said shaft being rotatable by said abutment of said lug and said first abutment surface when said piston rod is shifted by said cylinder toward said door-opening position to rotate said lever against the action of said spring assembly until said pivotal connection between said free end of said lever and said first end of said spring assembly passes to a second over-center position below said imaginary line and said restraint assembly achieves a non-restraining condition wherein said first abutment surface of said shaft notch is no longer in position to be abutted by said door-actuating means lug and said door-actuating means is free to shift to its door-opening position, said door-actuating means lug being so positioned as to engage said second abutment surface of said shaft notch to rotate said shaft and return said restraint assembly to its restraining condition with said pivotal connection between said lever free end and said spring assembly first end being in said first over-center position when said cylinder is actuated to shift said piston rod and said door-actuating means to said door-closing position.

7. The structure claimed in claim 6 wherein said first bracket comprises first and second L-shaped members, said first L-shaped member having a horizontal base portion affixed said car and a vertical portion having a perforation therein to rotatively mount one end of said shaft, said second L-shaped member having a horizontal base portion removably affixed to said base portion of said first L-shaped member and a vertical portion having a perforation therein to rotatively mount the other end of said shaft, means on said shaft to prevent axial shifting of said shaft with respect to said vertical portions of said first and second L-shaped members.

8. The structure claimed in claim 6 wherein said spring assembly comprises a front plate, a rear plate and a coil spring, said coil spring having a first end abutting said front plate and a second end abutting said rear plate, means on said front and rear plates to maintain their respective first and second abutting coil spring ends centered with respect thereto, said front plate having a pair of parallel, rearwardly extending rod-like members mounted thereon, said rear plate having a pair of perforations, said rod-like members passing through said rear plate perforations with a sliding fit, said rod-like members being located at diametrically opposed positions along side said coil spring to maintain proper alignment of said coil spring and said front and rear plates, a pair of forwardly projecting lugs on said front plate lying to either side of said free end of said lever, said lugs and said free end of said lever having transverse perforations therein with a pivot pin extending therethrough, said second bracket comprising a base portion affixed to said upper surface of said center sill and an upstanding vertical portion, a pair of rearwardly extending lugs on said rear plate lying to either side of said vertical portion of said second bracket, said last mentioned lugs and said vertical portion of said second bracket having transverse perforations with a pivot pin extending therethrough.

* * * * *